US006203345B1

(12) United States Patent
Roque et al.

(10) Patent No.: US 6,203,345 B1
(45) Date of Patent: Mar. 20, 2001

(54) FLEXIBLE CIRCUIT CONNECTOR

(75) Inventors: David Roque, Boiling Spring, SC (US); Rajagopalan Chandrasekhar, Hunting Beach, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/438,125

(22) Filed: Nov. 9, 1999

(51) Int. Cl.[7] ..... H01R 12/28
(52) U.S. Cl. ..... 439/260; 439/495; 439/910
(58) Field of Search ..... 439/260, 495, 439/910

(56) References Cited

U.S. PATENT DOCUMENTS

| | | | | |
|---|---|---|---|---|
| 5,498,169 | * | 3/1996 | Ikemoto | 439/495 |
| 5,695,360 | * | 12/1997 | Seto et al. | 439/260 |
| 5,785,549 | * | 7/1998 | Takayasu | 439/495 |
| 5,842,883 | * | 12/1998 | Igarashi et al. | 439/260 |
| 5,904,586 | * | 5/1999 | Takayasu | 439/260 |

* cited by examiner

*Primary Examiner*—Gary F. Paumen
(74) *Attorney, Agent, or Firm*—Wei Te Chung

(57) ABSTRACT

A flexible circuit connector includes a housing defining an interior space for receiving a flexible circuit. Conductive contacts are retained in the housing, each having a concave portion extending into the interior space for electrically engaging the flexible circuit. An actuator pivotally attached to the housing for being moveable between an open position where an opening is formed between the actuator and the housing for insertion of the flexible circuit into the housing and a closed position where the actuator engages and thus securely retains the circuit board in the housing. The contacts are arranged to have the concave portions thereof substantially aligned with a rotational axis of the actuator for reducing coupling force required for moving the actuator from the open position to the closed position. At least one inspection window is defined in the housing in communication with the interior space for visual inspection of the flexible circuit received in the housing. The actuator has two spaced arms each forming a pivot pin received in a hole defined in the housing. A slot is defined in the housing extending from the hole for guiding the pivot pin into the hole. A retainer is mounted to the housing and engages the pivot pin for retaining the pivot pin in the hole. A soldering tab extends from the retainer for being soldered to a circuit board to fix the connector to the circuit board.

1 Claim, 9 Drawing Sheets

FLEXIBLE CIRCUIT CONNECTOR

BACKGROUND OF THE INVENTION

1. Field of the Invention

The present invention generally relates to a flexible circuit connector, and in particular to a flexible circuit connector having a low to zero coupling force (moment).

2. The Prior Art

A flexible circuit connector connects a flexible circuit board to a rigid circuit board. The flexible circuit connector comprises an insulative housing mounted to the rigid circuit board. A plurality of slots is defined in the housing for receiving and retaining conductive contacts electrically connected to the rigid circuit board. An opening is defined in the housing in communication with the slots for receiving an end portion of a flexible circuit whereby conductive traces printed on the flexible circuit board electrically engage the contacts. An actuator is attached to the housing for securing the flexible circuit to the connector. The actuator may be detachable from the connector or movably mounted to the housing to render the actuator movable between an open position where a space is present between the actuator and the housing for the insertion of the flexible circuit and a closed position where the actuator engages and applies a force on the flexible circuit to secure the flexible circuit between the actuator and the housing and ensure proper electrical engagement between the flexible circuit and the contacts. Examples of conventional flexible circuit connectors are those disclosed in U.S. Pat. Nos. 3,989,336, 4,334,728, 4,449,773, 4,477,137, 4,647,131, 4,718,859, 4,778,403, 4,936,792, 5,639,260, 5,458,506, 5,580,272, 5,695,359, 5,695,360, 5,741,154, 5,753,709, 5,785,549, 5,824,883, 5,839,917, 5,895,287, and 5,904,586.

Some of the conventional flexible circuit connectors have a sophisticated structure which complicates the manufacturing process thereof and increases costs. Another disadvantage of the conventional flexible circuit connectors is that they require a large coupling force (moment) in securing a flexible circuit thereto. Furthermore, in certain cases, the conventional flexible circuit may not be effective in securing the flexible circuit.

It is thus desired to provide a flexible circuit connector, which overcomes the problems, discussed above.

SUMMARY OF THE INVENTION

Accordingly, an object of the present invention is to provide a flexible circuit connector having a simple structure.

Another object of the present invention is to provide a flexible circuit connector requiring a small coupling force in securing a flexible circuit.

A further object of the present invention is to provide a flexible circuit connector capable to effectively engaging and securing a flexible circuit.

A further object of the present invention is to provide a flexible circuit connector having an actuator fixed by an actuator retainer which also serves as a soldering tab of the connector.

Yet a further object of the present invention is to provide a flexible circuit connector having inspection windows defined therein for visual inspection of proper seating of a flexible circuit in the connector.

To achieve the above objects, a flexible circuit connector in accordance with the present invention comprises an insulative housing defining an interior space for receiving a flexible circuit. Conductive contacts are retained in the housing, each having a concave portion extending into the interior space for engaging the flexible circuit. An actuator is pivotally attached to the housing for being moveable between an open position where an opening is formed between the actuator and the housing for insertion of the flexible circuit and a closed position where the actuator engages and thus securely retains the circuit board in the housing. The contacts are arranged to have the concave portions thereof substantially aligned with a rotational axis of the actuator for reducing coupling force required for moving the actuator from the open position to the closed position. At least one inspection window is defined in the housing in communication with the interior space for visual inspection of the flexible circuit received in the housing. The actuator has two spaced arms each forming a pivot pin received in a hole defined in the housing. A slot is defined in the housing extending from the hole for guiding the pivot pin into the hole. A retainer is mounted to the housing and engages the pivot pin for retaining the pivot pin in the hole. A soldering tab extends from the retainer for being soldered to a circuit board to fix the connector to the circuit board.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
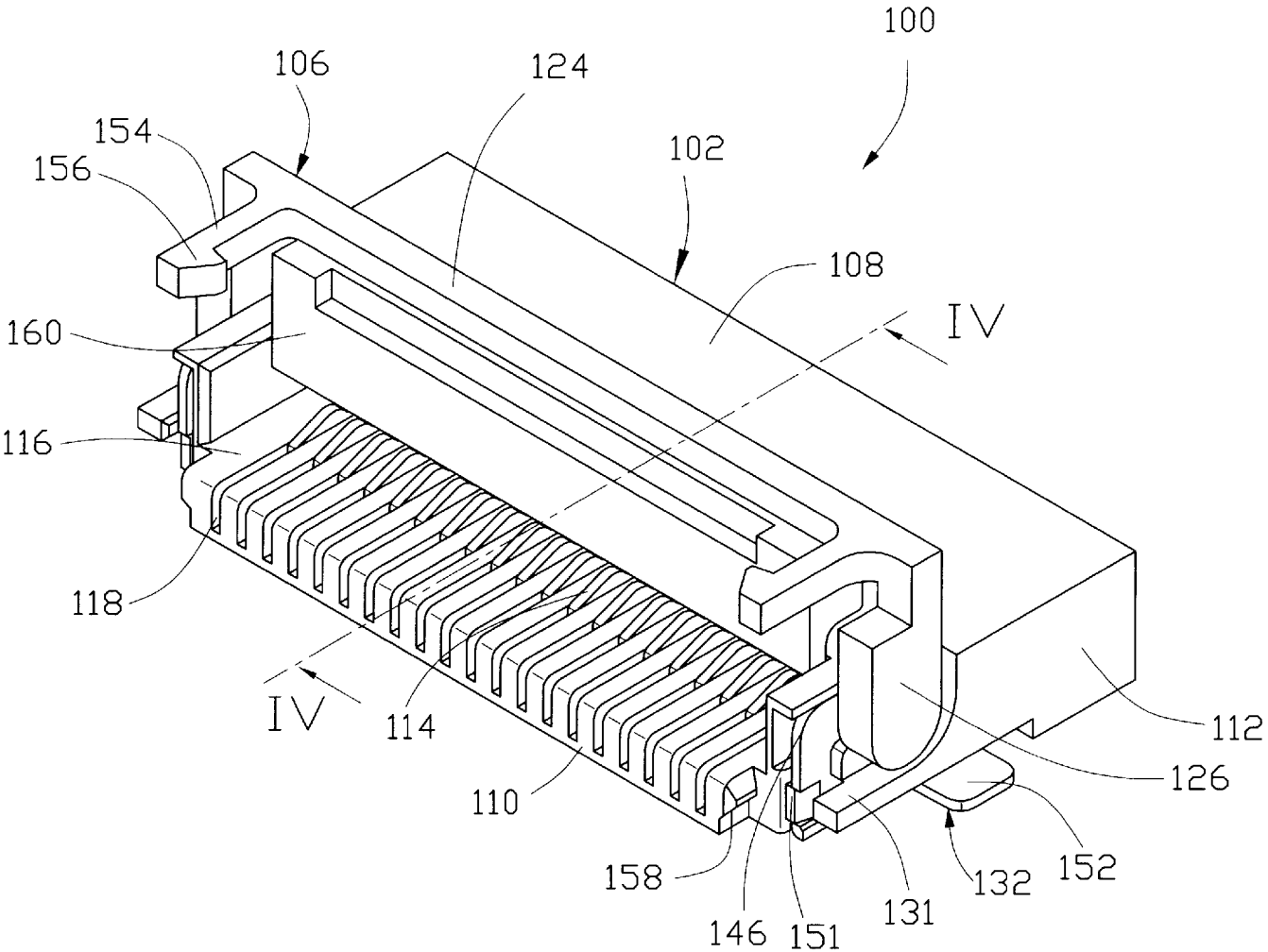
FIG. 1 is a perspective view of a flexible circuit connector constructed in accordance with a first embodiment of the present invention in an open position.
Figure 2:
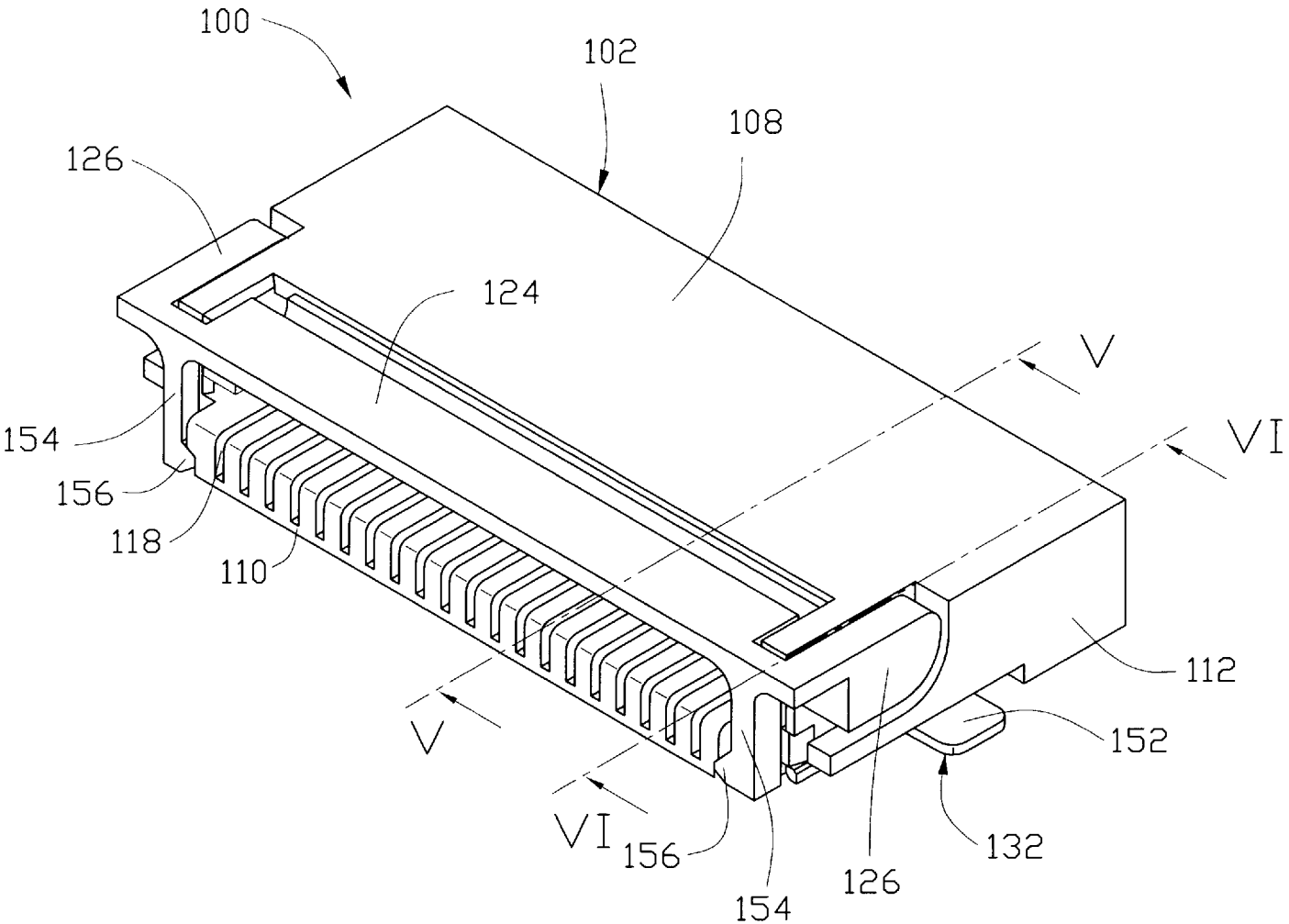
FIG. 2 is similar to FIG. 1 but showing the flexible circuit connector in a closed position.
Figure 3:
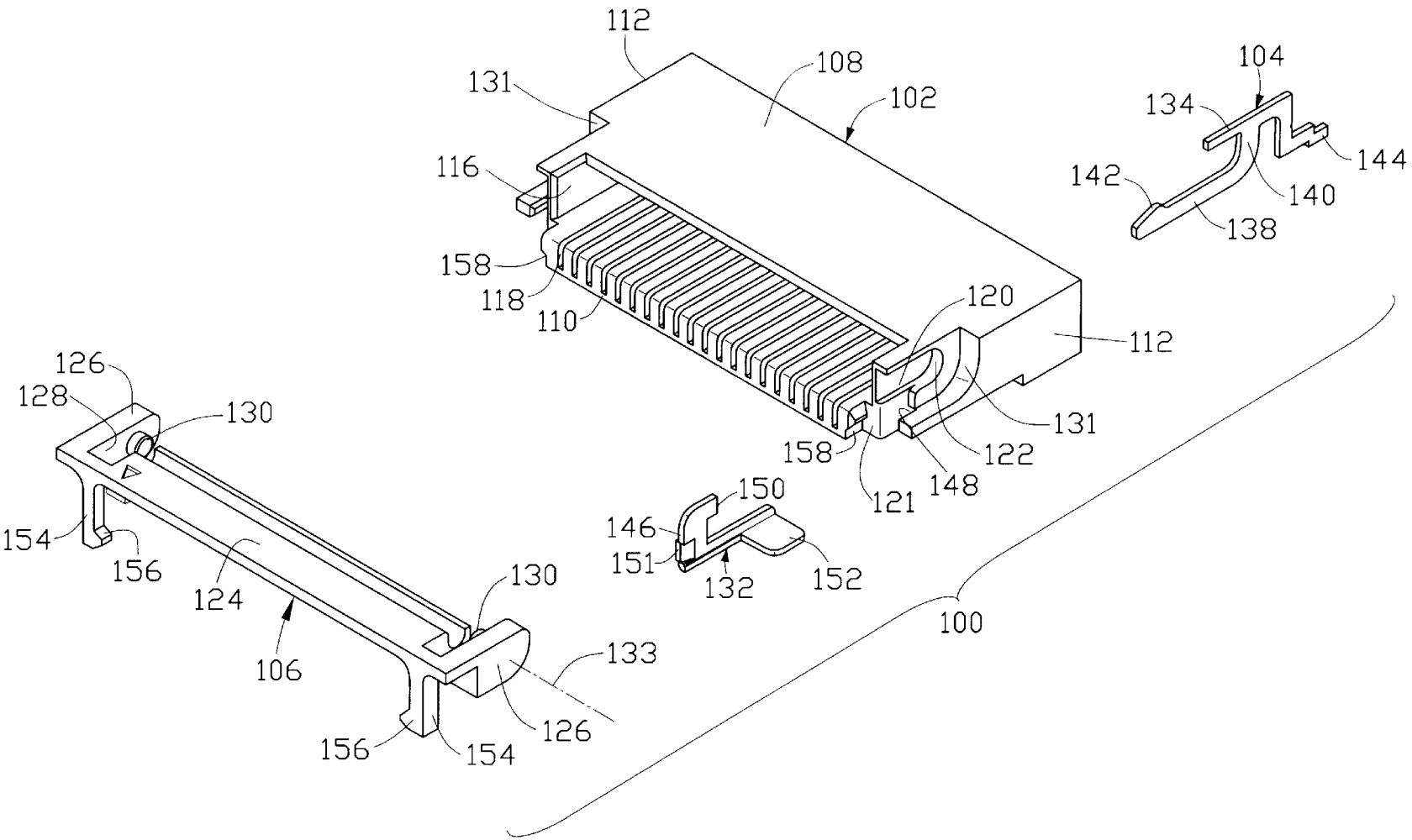
FIG. 3 is an exploded view of the flexible circuit connector of FIG. 1.

Referring to the drawings and in particular to FIGS. 1–3, a flexible circuit connector 100 in accordance with a first embodiment of the present invention comprises an insulative housing 102 retaining a plurality of conductive contacts 104 therein and a movable actuator 106 made of insulative material pivotally attached to the housing 102 for moving with respect thereto between a closed position (FIG. 2) and an open position (FIG. 1).

The housing 102 comprises horizontally extending top and bottom walls 108, 110 connected by opposite, vertically extending side walls 112 for defining an interior space 114 (FIGS. 4 and 5) having a front opening 116. A plurality of contact receiving grooves 118 is defined in the bottom wall 110 in communication with the interior space 114 for receiving and retaining the contacts 104 therein.

A pivot receiving slot 120 is defined in an outside face of each side wall 112 of the housing 102 and exposed to the front face 121 of the housing 102. The pivot receiving slot 120 terminates at a circular hole 122 whereby the hole 122 has a side opening (not labeled) formed by the pivot receiving slot 120. The actuator 106 comprises an elongate bar 124 with two arms 126 extending from opposite ends thereof and spaced therefrom by gaps 128. The arms 126 correspond to the side walls 112 of the housing 102 with a distance therebetween substantially corresponding to a distance between the outside faces of the side walls 112.

A pivot pin 130 extends from an inside face of each arm 126 of the actuator 106 for being inserted into the pivot receiving slot 120 of the corresponding side wall 112 from the front side 121 of the housing 102 and moved to and retained in the hole 122 by an actuator retainer 132 for defining a rotational axis 133 about which rotation of the actuator 106 with respect to the housing 102 may be performed. The actuator retainer 132 will be further described.

Preferably, a recessed portion 131 is defined in each side wall 112 of the housing 102 for accommodating the corresponding arm 126 of the actuator 106. The pivot receiving slot 120 is thus defined in a recessed face of the recessed portion 131 as shown.

Figure 4:
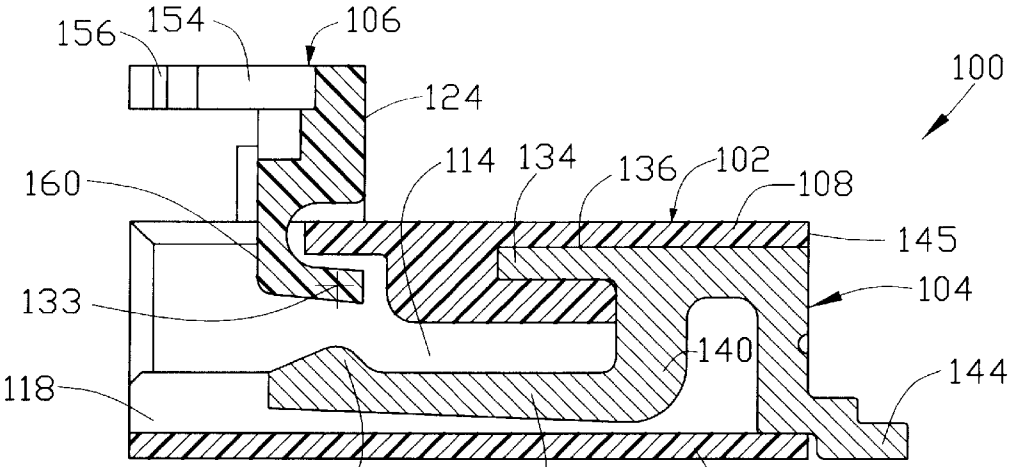
FIG. 4 is a cross-sectional view taken along line IV—IV of FIG. 1.
Figure 5:
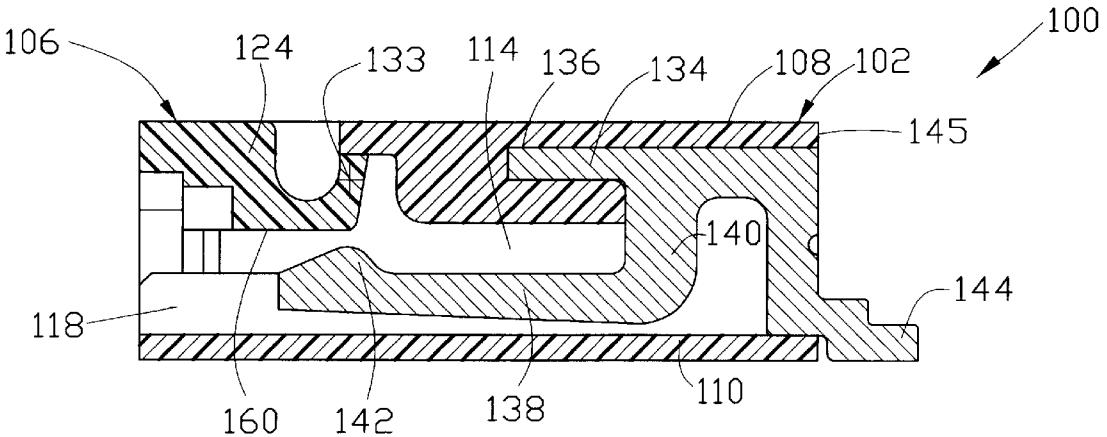
FIG. 5 is a cross-sectional view taken along line V—V of FIG. 2.

Also referring to FIGS. 4 and 5, each contact 104 comprises an anchoring arm 134 interferentially received in a slot 136 defined in the housing 120 in communication with the interior space 114. The slot 136 has a closed inner end and a length of the slot 136 substantially corresponds to the length of the anchoring arm 134. An engaging arm 138 is connected to the anchoring arm 134 by a connection 140 whereby the engaging arm 138 is spaced from and substantially parallel to the anchoring arm 134. The engaging arm 138 is inserted into and positioned in the corresponding contact receiving groove 118 of the bottom wall 110 and partially extends into the interior space 114. The engaging arm 138 is made resilient and is spaced from a bottom of the contact receiving groove 118 whereby the engaging arm 138 undergoes a downward deflection when a force is applied thereon. A concave portion 142 is formed on the engaging arm 138 and facing the actuator 106. The engaging arm 138 is dimensioned to have the concave portion 142 thereof substantially aligned with the rotational axis 133 of the pivot pins 130 in a vertical direction substantially normal to the engaging arm 138 and the rotational axis 133 that extend substantially horizontally.

A tail section 144 extends from the connection 140 in a direction opposite to the engaging arm 138 and the anchoring arm 134. The tail section 144 partially projects beyond a rear face 145 (FIGS. 4–6) of the housing 102 for being mounted to a circuit board (not shown) by means of for example soldering. In the embodiment illustrated, the tail section 144 has a lower edge substantially aligned with the bottom 110 of the housing 102 for surface mounted to the circuit board. However, the tail section 144 may be shaped for connecting to the circuit board by means of a through hole technique or other equivalent techniques.

Figure 6:
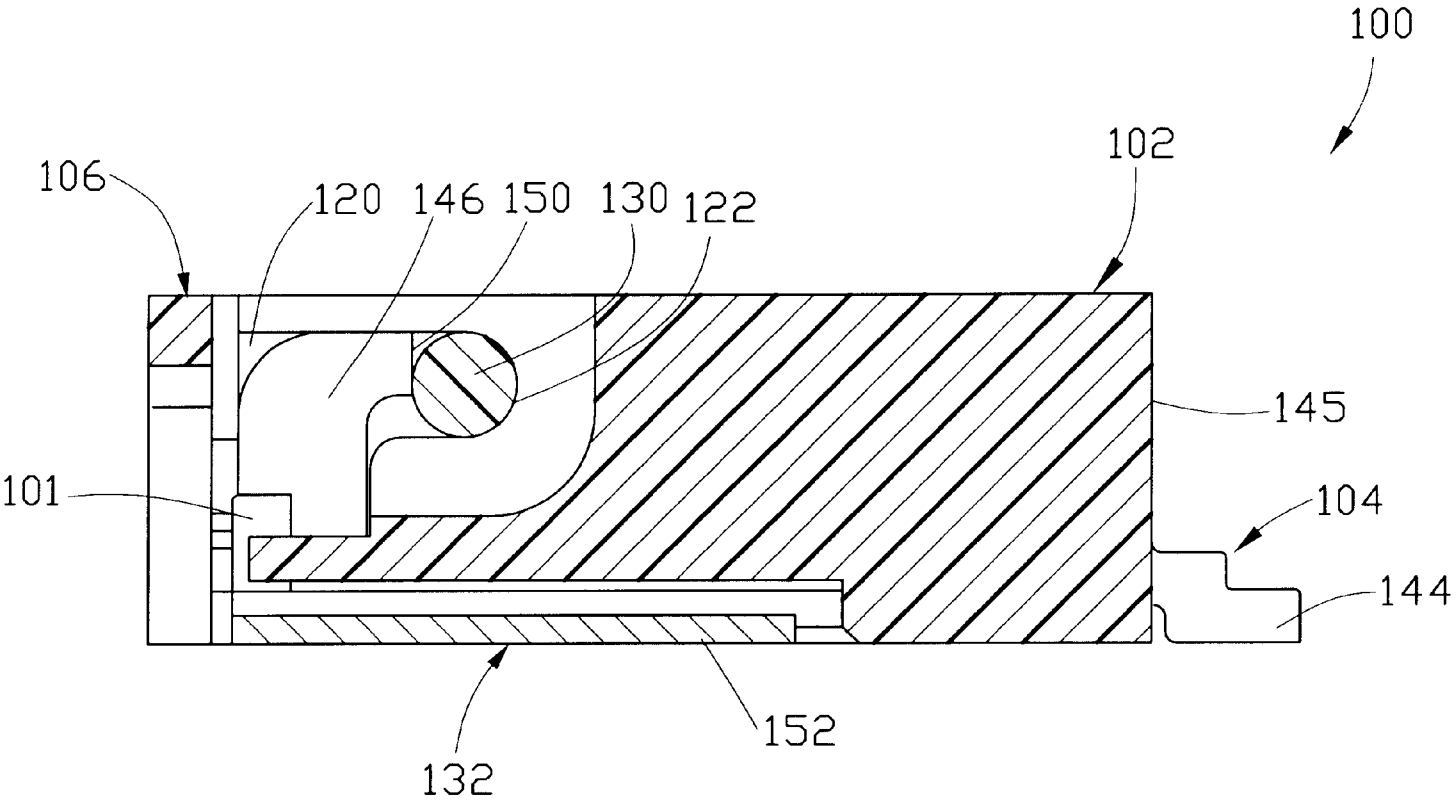
FIG. 6 is a cross-sectional view taken along line VI—VI of FIG. 2.

Also referring to FIG. 6, the actuator retainer 132 comprises a retaining section 146 interferentially received and retained in a retainer receiving slot 148 defined in each side wall 112 of the housing 102 whereby an edge 150 thereof contacts the corresponding pivot pin 130 of the actuator 106 at a location substantially opposite to the hole 122 and thus closing the side opening thereof for retaining the pivot pin 130 in the hole 122. Preferably, an inclination 151 is stamped on the retaining section 146 for interferentially engaging with the housing 102 thereby fixing the actuator retainer 132 to the housing 102.

A soldering tab 152 extends from the retaining section 146 of the actuator retainer 132. The soldering tab 152 is substantially flush with the bottom face of the housing 102 for being surface mounted to the circuit board thereby securing the flexible circuit connector 100 to the circuit board. Integrating the soldering tab 152 with the actuator retainer 132 makes the number of parts reduced and the assembly process simplified. Also, a sound and effective mounting of the connector 100 to a circuit board may be readily achieved.

A pair of latching arms 154 extend from the bar 124 of the actuator 106 and each forms an inward projecting barb 156 for engaging with a corresponding notch 158 defined in the bottom wall 110 of the housing 102 for releasably fixing the actuator 106 at the closed position.

Referring back to FIGS. 4 and 5, the bar 124 of the actuator 106 has a pressure face 160 which opposes the concave portions 142 of the contacts 104 when the actuator 106 is at the closed position as shown in FIG. 5 whereby a flexible circuit (not shown) received in the connector 100 is secured between the pressure face 160 and the concave portions 142 of the contacts 104 and electrically engages with the contacts 104.

Arranging the concave portions 142 of the contacts 104 to be substantially aligned with the rotational axis 133 of the pivot pins 130 effectively reduces moment acting upon the actuator 106 when the actuator 106 is moved from the open position to the closed position. This is partly because vertically aligning the concave portions 142 of the contacts 104 with the rotational axis 133 substantially eliminates horizontal offset therebetween thereby reducing moment caused by the offset.

Figure 7:
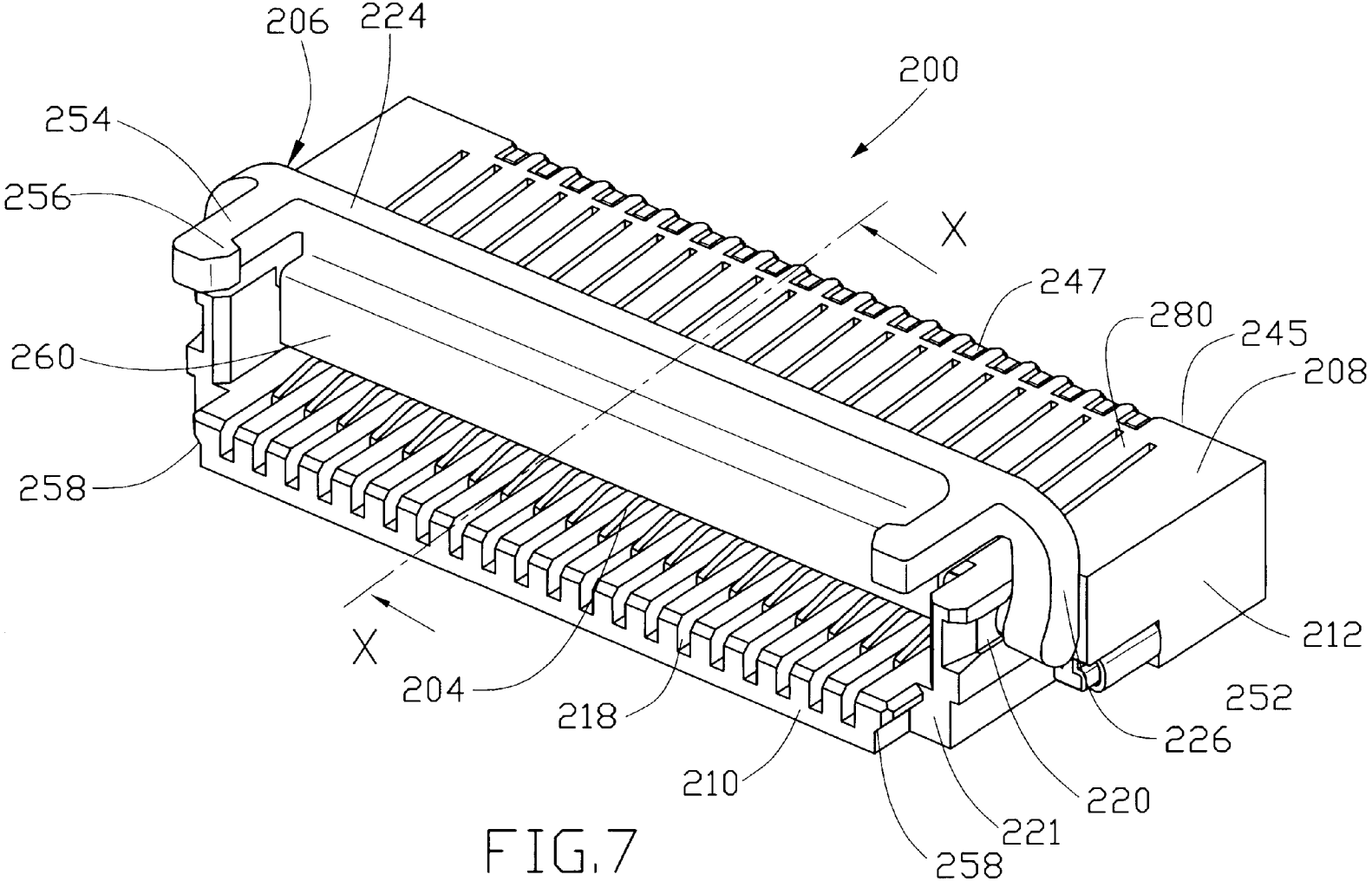
FIG. 7 is a perspective view of a flexible circuit connector constructed in accordance with a second embodiment of the present invention in an open position.
Figure 8:
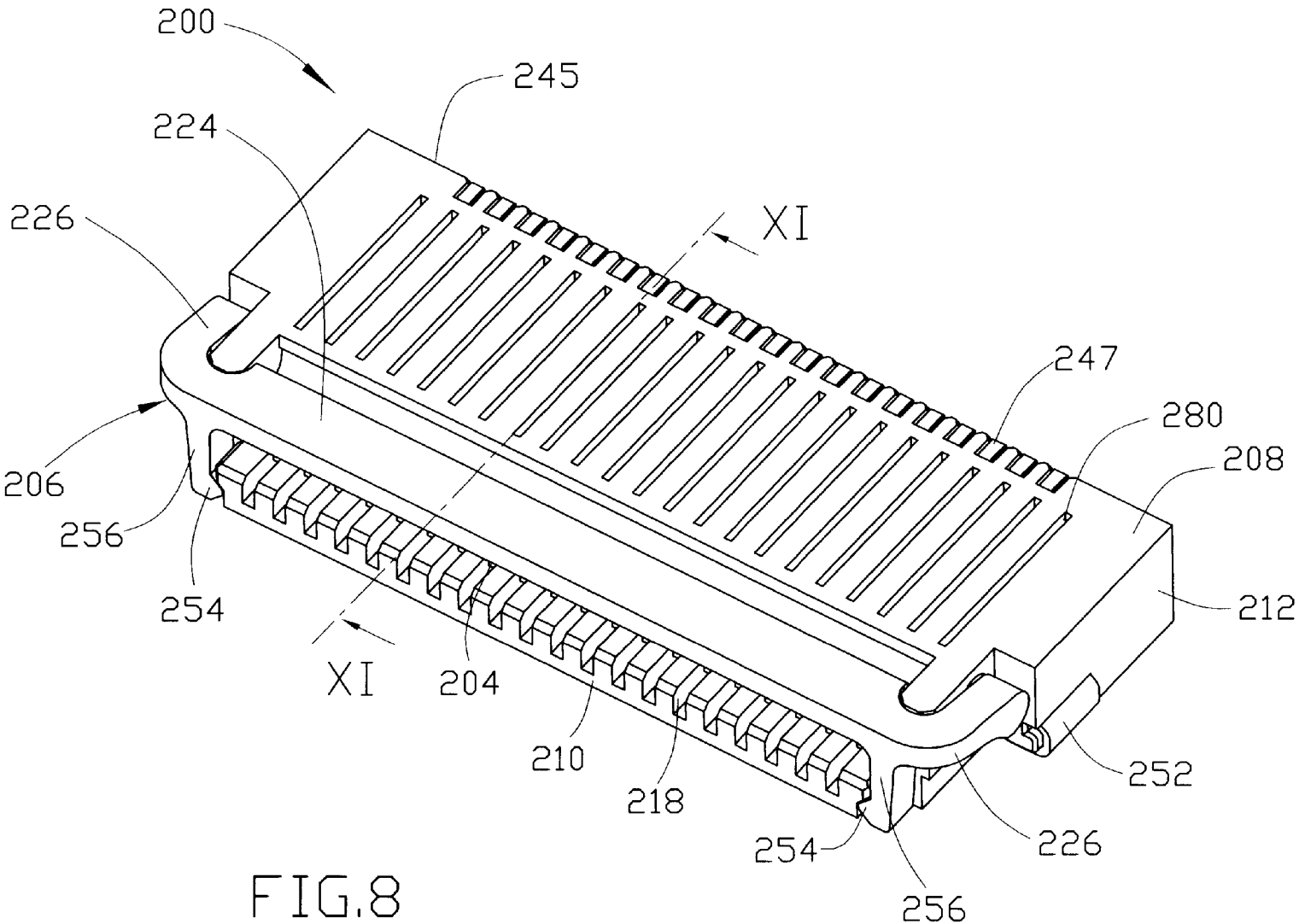
FIG. 8 is similar to FIG. 7 but showing the flexible circuit connector in a closed position.
Figure 9:
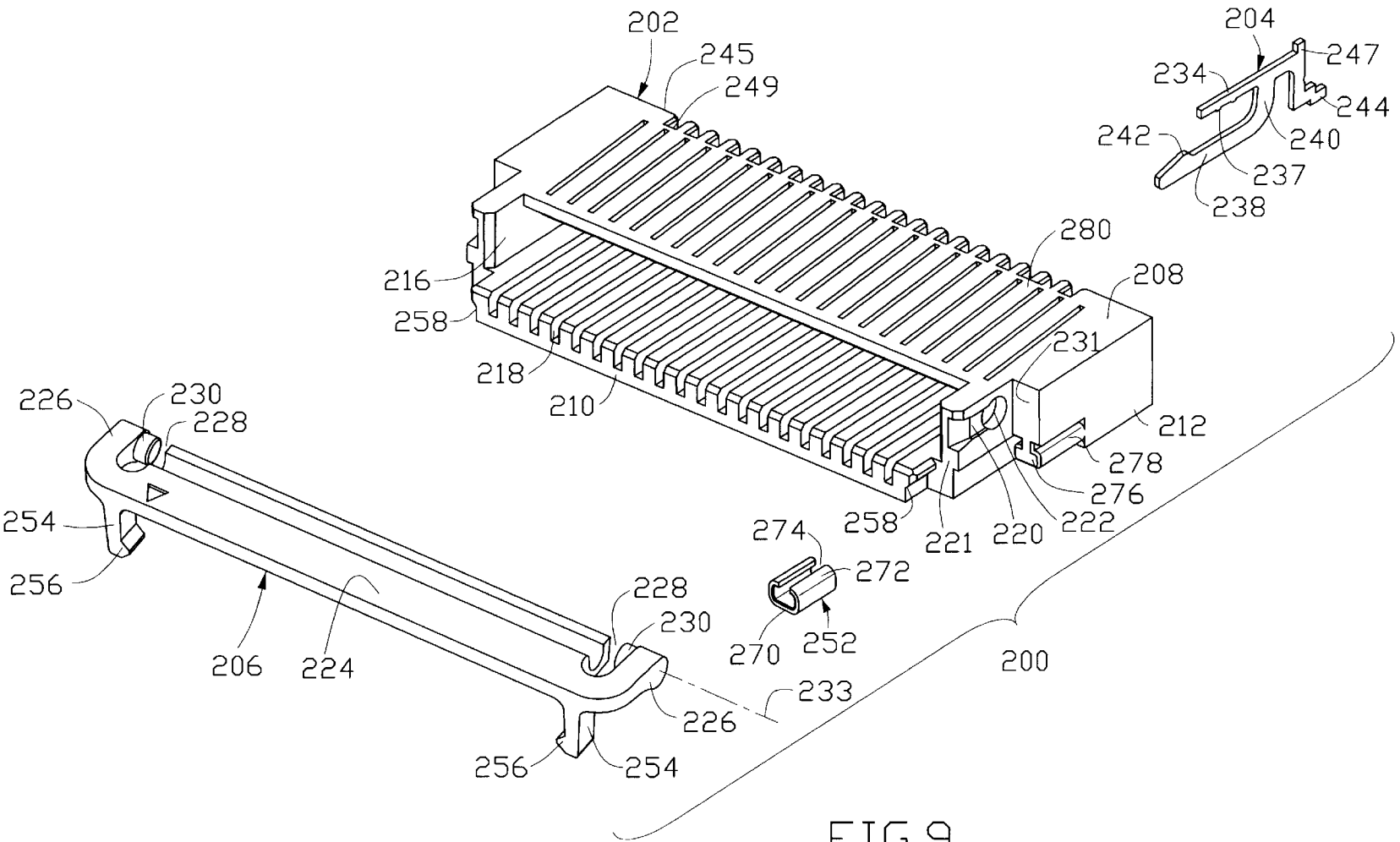
FIG. 9 is an exploded view of the flexible circuit connector of FIG. 7.
Figure 10:
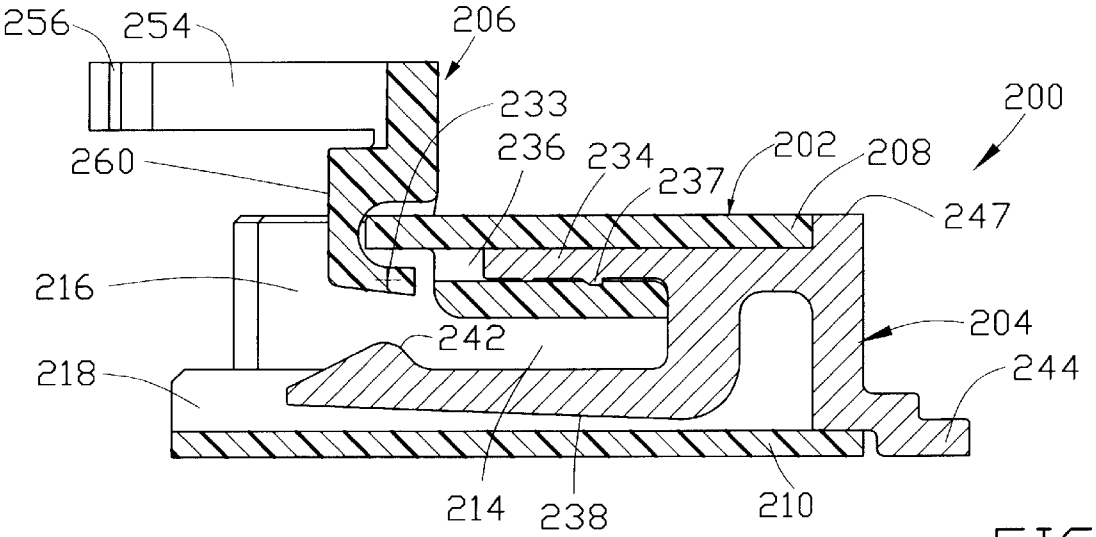
FIG. 10 is a cross-sectional view taken along line X—X of FIG. 7.

FIGS. 7–11 show a second embodiment of the present invention wherein a flexible circuit connector 200 comprises an insulative housing 202 retaining a plurality of conductive contacts 204 therein and a movable actuator 206 made of insulative material pivotally attached to the housing 202 for moving with respect thereto between a closed position (FIGS. 8 and 11) and an open position (FIGS. 7 and 10). The housing 202 comprises horizontally extending top and bottom walls 208, 210 connected by opposite, vertically extending side walls 212 for defining an interior space 214 (FIGS. 10 and 11) having a front opening 216. A plurality of contact receiving grooves 218 is defined in the bottom wall 210 in communication with the interior space 214 for receiving and retaining the contacts 204 therein.

A pivot receiving slot 220 is defined in an outside face of each side wall 212 of the housing 102 and exposed to the front face 221 of the housing 202. The pivot receiving slot 220 terminates at a circular hole 222. The actuator 206 comprises an elongate bar 224 with two arms 226 extending from opposite ends thereof and spaced therefrom by gaps 228. The arms 226 correspond to the side walls 212 of the housing 202 with a distance therebetween substantially corresponding to a distance between the outside faces of the side walls 212.

A pivot pin 230 extends from an inside face of each arm 226 of the actuator 206 for being inserted into the pivot receiving slot 220 of the corresponding side wall 212 from the front side 221 of the housing 202 and moved into and rotatably retained in the hole 222 for defining a rotational axis 233 about which rotation of the actuator 206 with respect to the housing 202 may be performed. In the embodiment illustrated, the hole 222 has a depth greater than the depth of the pivot receiving slot 220 for securely retaining the pivot pin 230 therein.

Preferably, a recessed portion 231 is defined in each side wall 212 of the housing 202 for accommodating the corresponding arm 226 of the actuator 206. The pivot receiving slot 220 is thus defined in a recessed face of the recessed portion 231 as shown.

Figure 11:
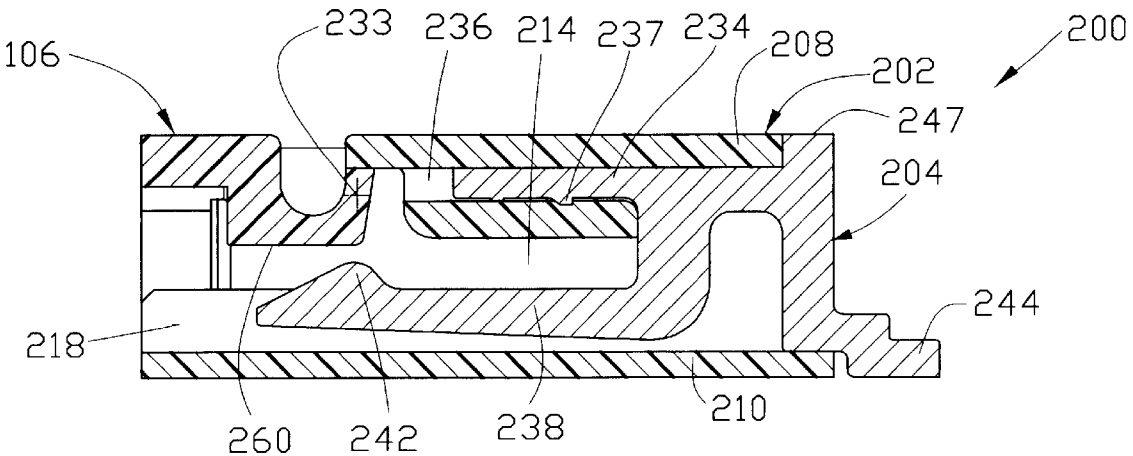
FIG. 11 is a cross-sectional view taken along line XI—XI of FIG. 8.

Also referring to FIGS. 10 and 11, each contact 204 comprises an anchoring arm 234 interferentially received in a slot 236 defined in the housing 220 in communication with the interior space 214. Both ends of the slot 236 are open in the embodiment illustrated. Preferably, the anchoring arm 234 forms barbs 237 for interferentially engaging with the slot 236 and thus securely fixing the contact 204 in the housing 202. An engaging arm 238 is connected to the anchoring arm 234 by a connection 240 whereby the engaging arm 238 is spaced from and substantially parallel to the anchoring arm 234. The engaging arm 238 is inserted into and positioned in the corresponding contact receiving groove 218 of the bottom wall 210 and partially extends into the interior space 214. The engaging arm 238 is made resilient and is spaced from a bottom of the contact receiving groove 218 whereby the engaging arm 238 undergoes a downward deflection when a force is applied thereon. A concave portion 242 is formed on the engaging arm 238 and facing the actuator 206. The engaging arm 238 is dimensioned to have the concave portion 242 thereof substantially aligned with the rotational axis 233 of the pivot pins 230 in a vertical direction substantially normal to the engaging arm 238 and the rotational axis 233 that extend substantially horizontally.

A tail section 244 extends from the connection 140 in a direction opposite to the engaging arm 238 and the anchoring arm 234. The tail section 244 partially projects beyond a rear face 245 of the housing 202 for being mounted to a circuit board (not shown) by means of for example soldering. In the embodiment illustrated, the tail section 244 has a lower edge substantially aligned with the bottom 210 of the housing 202 for surface mounted to the circuit board.

A support section 247 extends from the anchoring arm 234 of the contact 204 for being received in a corresponding slot 249 defined in the rear face 245 of the housing 202 thereby properly positioning the contact 204 with respect to the housing 202.

A soldering tab 252 having a C-shaped cross section comprises a bottom section 270 and two spaced top sections 272 defining an opening 274 therebetween. A projection 276 is formed on each side wall 212 of the housing 202 with grooves 278 defined in opposite sides thereof for slidably receiving the top sections 272 of the soldering tab 252 thereby securely attaching the soldering tab 252 to the side wall 212. The projection 276 and the soldering tab 252 are dimensioned to have the bottom section 270 of the soldering tab 252 substantially flush with the bottom face of the housing 202 for being surface mounted to the circuit board thereby securing the flexible circuit connector 200 to the circuit board.

A pair of latching arms 254 extend from the bar 224 of the actuator 206 and each forms an inward projecting barb 256 for engaging with a corresponding notch 258 defined in the bottom wall 210 of the housing 202 for releasably fixing the actuator 206 at the closed position.

The bar 224 of the actuator 206 has a pressure face 260 which opposes the concave portions 242 of the contacts 204 when the actuator 206 is at the closed position as shown in FIG. 5 whereby a flexible circuit (not shown) received in the connector 200 is secured between the pressure face 260 and the concave portions 242 of the contacts 204 and electrically engages with the contacts 204.

Slits 280, serving as inspection windows, are defined in the top wall 208 of the housing 202, slightly laterally offset from the adjacent contacts 204, in communication with the interior space 214 whereby a user may visually inspect if the flexible circuit is properly seated inside the connector 200 by observing through the slits 280.

Although the present invention has been described with reference to the preferred embodiments, it is apparent to those skilled in the art that a variety of modifications and changes may be made without departing from the scope of the present invention which is intended to be defined by the appended claims.

What is claimed is:

1. A flexible circuit connector comprising:

an insulative housing having horizontally extending top and bottom walls connected by opposite side walls defining an interior space therebetween adapted to receive a flexible circuit;

a plurality of conductive contacts retained in the housing, each contact comprising an engaging section having a concave portion extending into the interior space wall; and an insulative actuator pivotally attached to the housing by pivot means having a rotational axis, the actuator being movable between an open position for allowing insertion of the flexible circuit into the housing and a closed position where the actuator presses the flexible circuit against the concave portions of the conductive contacts;

wherein the conductive contacts are dimensioned and positioned to have the concave portion substantially aligned with the rotational axis in a vertical direction;

wherein the actuator comprises an elongate bar with two arms extending from opposite ends thereof, the pivot means comprising pivot pins extending from the arms along the rotational axis, the pivot means further comprising holes defined in the side walls for rotatably receiving the pivot pins;

wherein a pivot receiving slot is defined in each side wall of the housing extending from the hole to a front face of the housing thereby forming a side opening of the hole through which the pivot pin is moved into the hole, an actuator retainer being attached to each side wall of the housing for closing the side opening of the hole and engaging and thus securely retaining the pivot pin in the hole;

wherein the actuator retainer comprises a retaining section interferentially received in a slit defined in the corresponding side wall, the retaining section having an edge engaging and retaining the pivot pin;

wherein a soldering tab extends from the retaining section adapted to be mounted to a circuit board for fixing the flexible circuit connector to the circuit board;

wherein at least one inspection window is defined in the top wall of the housing for visual inspection of the flexible circuit received in the housing;

wherein each contact comprises an anchoring section interferentially received in a blind hole defined in the housing for retaining the contact in the housing, the anchoring section having a length substantially corresponding to a depth of the blind hole;

wherein each contact comprises a support section received in a slot defined in a rear face of the housing for properly positioning the contact with respect to the housing.

* * * * *